United States Patent [19]

Stearns

[11] 4,440,594

[45] Apr. 3, 1984

[54] METHOD AND APPARATUS OF CHEMICAL MILLING OF CHEMICAL MATERIALS

[76] Inventor: Llewelyn B. Stearns, 9213 E. Carron Dr., Pico Rivera, Calif. 90660

[21] Appl. No.: 427,734

[22] Filed: Sep. 29, 1982

[51] Int. Cl.[3] ..... C23F 1/00

[52] U.S. Cl. ..... 156/664; 156/651; 156/345; 156/639

[58] Field of Search ..... 134/26, 28, 61, 82, 134/83, 114, 198; 156/651, 654, 656, 664, 345, 640, 639

[56] References Cited

U.S. PATENT DOCUMENTS

| | | | |
|---|---|---|---|
| 2,802,726 | 8/1957 | Langsfeld | 156/639 X |
| 3,869,313 | 3/1975 | Jones et al. | 156/345 X |
| 4,053,347 | 10/1977 | Glenn | 156/642 X |

*Primary Examiner*—William A. Powell
*Attorney, Agent, or Firm*—I. Morley Drucker

[57] ABSTRACT

The field of this invention relates to an improved apparatus and method for chemical treatment or milling of materials that provides complete control of gases generated during the milling phase. The apparatus consists of a vapor-tight containment for all procedures before, during, and after treatment, i.e., milling which might result in the generation of noxious fumes.

To facilitate the treatment of nitrogen oxide gases, air dilution of off-gases is minimized, thus enhancing the reaction transforming the gases to the water soluble form. Reaction kinetics are improved so that near-perfect scrubber efficiency can be achieved.

The entire enclosure means is compartmentalized, yet substantially completely vapor-tight to provide a safe environment for personnel (i.e., during handling and inspection of workpieces) and to provide areas for other treatment of the workpieces (i.e., activation of workpiece surfaces by spraying with HCl acid). Workpieces can be transported from one compartment to the next while preserving the integrity of each compartment via a substantially vapor-tight track system between compartments. Each compartment is separated from adjacent compartments by substantially vapor-tight doors.

The generation of the greater volume of noxious gases during immersion milling will take place at the immersion tank. The airspace over the tank is delimited by the cover attached to the workpiece holder. This airspace is connected through a venting means to a scrubber system which may separately or in combination treat fumes from the other compartments of the apparatus.

20 Claims, 5 Drawing Figures

METHOD AND APPARATUS OF CHEMICAL MILLING OF CHEMICAL MATERIALS

BACKGROUND OF THE INVENTION

Chemical milling is a stationary non-combustion source of nitrogen oxide gases that contaminate the atmosphere. Noxious nitrogen oxide fumes are generated in copious amounts when steel, stainless steel, nickel, titanium and other various alloys are dissolved in acid solutions. These acid solutions are generally aqua regia except in the case of titanium where hydrofluoric acid is used in lieu of hydrochloric acid. In either case, the principal effluent gases are nitrogen oxides. Substantial control of nitrogen oxide fumes from any such milling operation is possible by enclosing the area of vapor production over the acid solution in which workpieces are immersed. (Brevik U.S. Pat. No. 3,320,105). In prevalent commercial usage, the present state of the art utilizes open tank milling with any noxious fumes being pumped away to be treated.

This invention generally relates to a complete enclosure of the milling process, thus allowing complete control of noxious fumes and providing a safe environment for personnel associated with the process. This apparatus can be distinguished from that used in the Brevik apparatus by its complete physical, vapor-tight enclosure of the acid solution tank. The Brevik system relied upon a partial liquid-seal, to prevent escape of noxious fumes, but, in practice, the liquid seal permitted noxious fumes to escape from the treatment tank area, especially when the treatment solution has been heated to perhaps 140°-180° F. for milling efficiency.

The apparatus of this invention is also more adaptable to commercial production needs than the system patented by Brevik. The method and means of introducing the workpieces into the acid solution is more practicable in this invention, and could easily be automated.

This invention features a compartmentalized containment, which is flexible enough to be suited to the specialized requirements of treating or milling various materials. The compartments allow for separation of differing treatments of workpieces, and provide additionally-vented areas, relatively free of noxious fumes where personnel can inspect or handle the workpieces before, during or after treatment of the workpiece.

The term "chemical milling" as used in the specifications and claims, refers to the selective dissolution of a material by an appropriate acid solution, and encompasses such a method whether it results in etching of a material to the predetermined depth, or results in complete perforation of the material.

SUMMARY OF THE INVENTION

The invention consists of an enclosed apparatus for chemical milling by acid solutions. The novel characteristic of the apparatus is the control of environmentally hazardous noxious fumes generated by the milling operation and associated procedures.

Workpieces are treated in compartments separated by vapor-tight doors, and transported from compartment to compartment via a vapor-tight gasketted track. The compartmentalizing minimizes the areas to be exposed to corrosive gases, thus allowing the use of less-expensive, less-corrosive-resistant materials in apparatus construction. All compartments are vented to a scrubber or other air treatment system.

In the instances of immersion or spray milling, the acid solution tank is fitted with a vapor-tight cover located on the workpiece holder to contain the gases generated when workpieces are immersed. Said cover also minimizes the air dilution of the gases generated. The airspace between the acid solution and tank cover is made to be of a minimum volume, just high enough to accommodate a vent pipe passing from the airspace and into a scrubber or other air treatment device.

BRIEF DESCRIPTION OF THE DRAWINGS

The invention will be more readily understood by reference to the attached drawings in which.

DETAILED DESCRIPTION OF THE INVENTION

Figure 1:
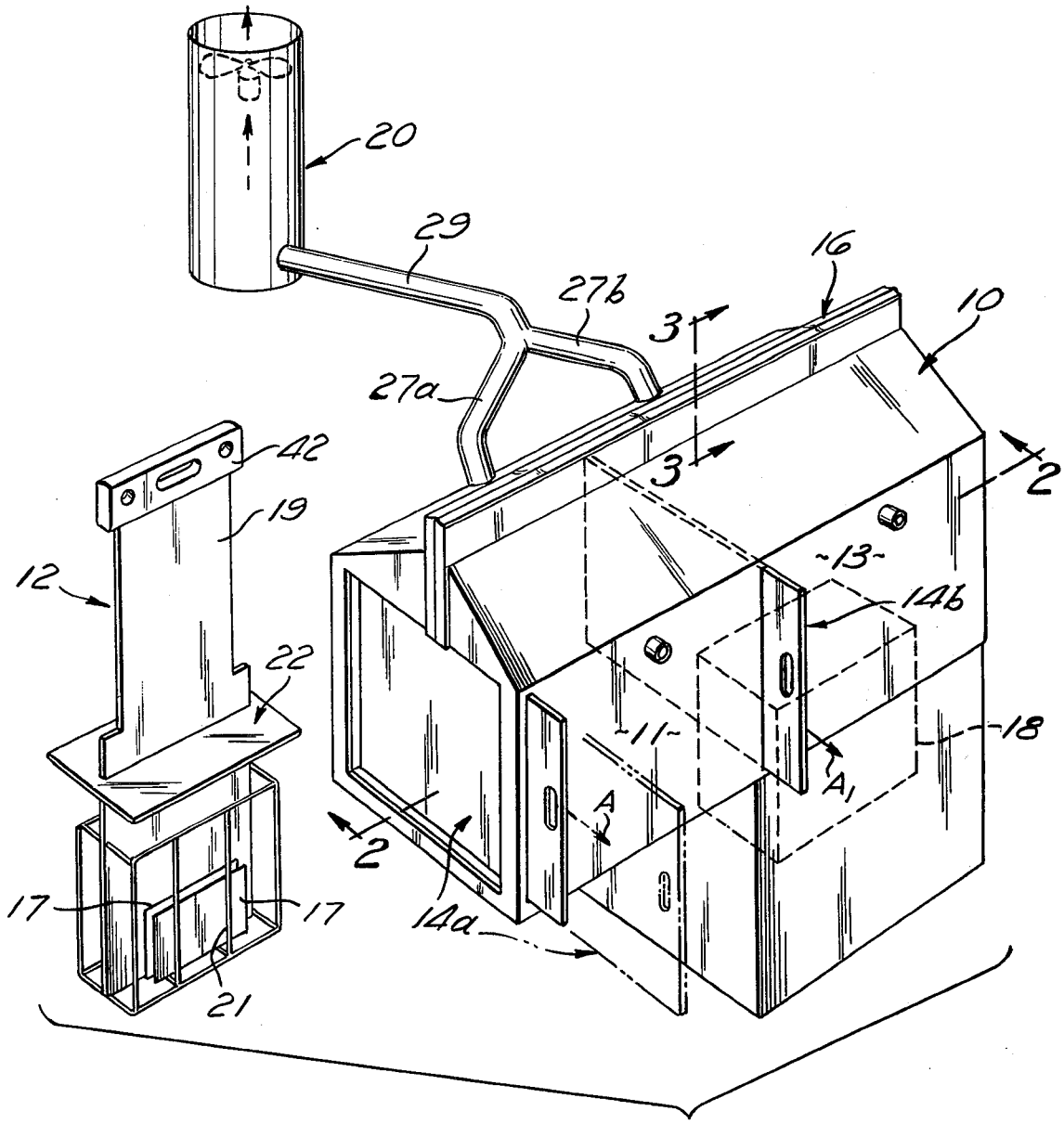
FIG. 1 is a schematic perspective view of a two compartment configuration of the invention with non-milling compartments communicating with, or vented to, a scrubber. At the left of FIG. 1, the workpiece holder is shown in perspective with the tank lid affixed to the holder.

FIG. 1 provides a schematic perspective view of containment section or zone 10 and workpiece holder 12. Entry into containment section 10 and division of the containment into separate subcompartments 11 and 13 is achieved by means of substantially vapor-tight, slideable partitions or doors **14*a*, 14*b*. This particular configuration of the invention is characterized by an outer subcompartment 11 for activation or other preliminary treatment of a workpiece 17 in workpiece holder 12, followed by the milling thereof by immersion into an appropriate acid solution in immersion tank 18. This invention is not limited to this particular configuration, and could also be adopted for spray type etching or milling of materials. The configuration is readily adaptable to any number of variations depending on the requirements of the material to be milled. Subcompartments of the containment 10, such as subcompartment 11 shown in FIG. 1 can be utilized for a variety of purposes, such as activation of workpiece 17 surface by spraying with hydrochloric acid, or for spraying and washing of workpiece 17 subsequent to milling, or for inspection of workpiece 17** between repeated immersions.

Figure 3:
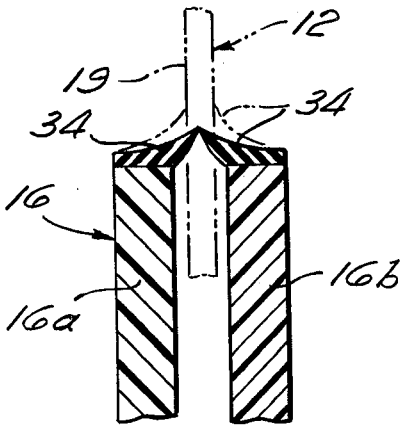
FIG. 3 shows a cross-sectional view, taken along the line 3—3 in FIG. 1, of the portion of the track with the gasket shown in solid lines. A portion of the workpiece holder positioned within the track, is shown with the gasket distended to provide a barrier to gas escape drawn in broken lines.

Transportation of workpiece holder 12 from the outermost subcompartment 11 to milling subcompartment 13 is accomplished by substantially vapor-tight gasketted track 16 which is shown, in enlarged detail, in FIG. 3. Workpiece holder 12 is provided with an elongated extension arm 19 affixed to a basket-like carrier or framework 21, for holding workpiece 17 to be treated or milled. The track 16 is formed at the roof of containment 10 by means of spaced walls 16*a* and 16*b* which run the length of the containment 10, communicating between subcompartments 11 and 13. Extension arm 19 of workpiece holder 12 will slideably interfit between track walls 16*a*, 16*b* as best shown in FIG. 3. The escape of gases between track walls 16*a*, 16*b* is prevented by the use of a pair of flexible, deformable gasket 34 which conform to the shape of extension arm 19 as it travels along track 16.

In FIG. 1, both subcompartments 11 and 13 are shown vented to a scrubber or similar treatment device 20 via ducts 27*a*, 27*b* and 29. It would be obvious to one skilled in the art that separate scrubbers or treatment devices could be used for each subcompartment, or in various combinations depending on the requirements of the material to be milled.

Workpiece holder 12 is provided with a gasketted lid or cover 22 which acts to provide a substantially vapor-tight seal with immersion tank 18 during milling. Holder cover 22 may be either fixedly attached or removably engaged to workpiece carrier 21 of holder 12 to facilitate ease of loading workpiece 17 into carrier 21.

Figure 2:
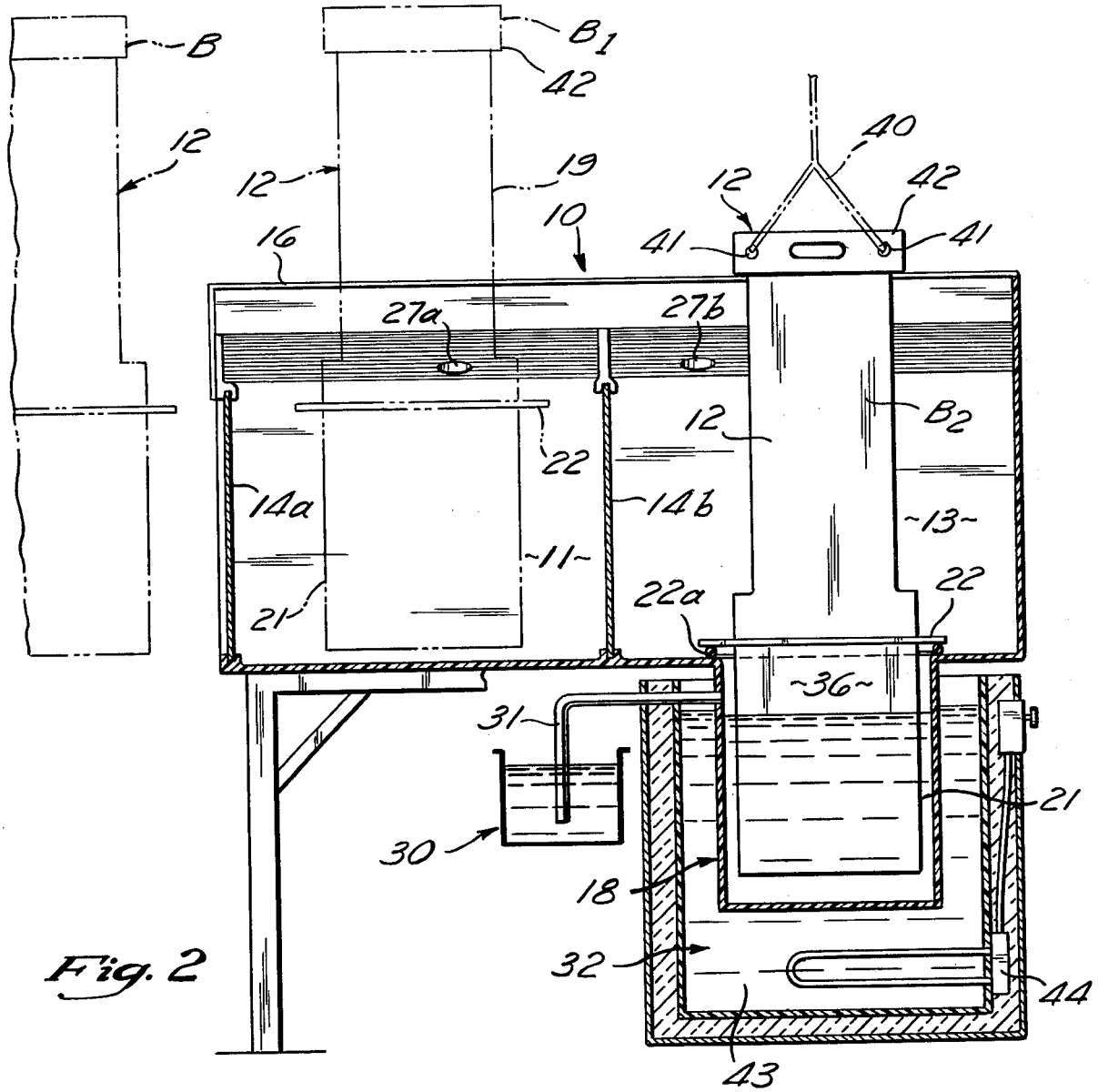
FIG. 2 is a cross-sectional view of the configuration shown in FIG. 1, taken along the line 2—2, with the workpiece holder drawn in solid lines in the milling position. The workpiece holder is shown in broken lines in positions prior to entry into the apparatus, and in the outermost compartment. Also shown in this view are a bath-type heater for the acid solution tank and a water tank to dissolve the gases generated by the actual milling.

As is best seen in FIG. 2, when holder 12 is in immersion tank 18, gasket 22*a* of holder cover 22 rests on the mouth of tank 18 to substantially prevent the escape of any fumes, noxious or otherwise, generated during the milling operation. It is to be noted that workpiece holder 12 is raised or lowered vertically, i.e., into and out of tank 18 by means of ropes, cables or the like, 40, affixed to openings 41 in the handle 42 affixed to extension arm 19 of workpiece holder 12.

Figure 5:
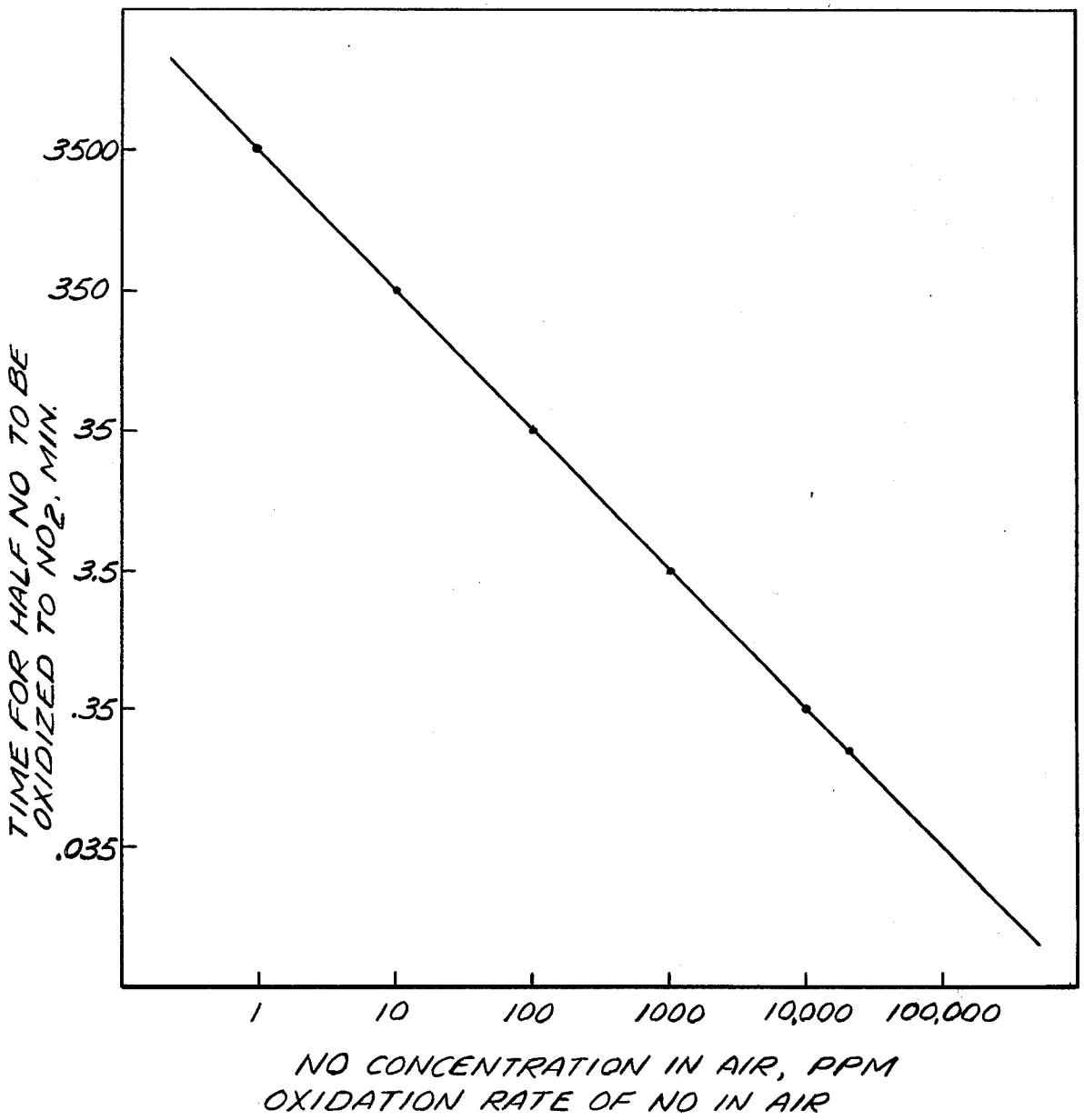
FIG. 5 represents the dependence of the oxidation rate of NO to $NO_2$ on the NO concentration in air.

A substantially airtight enclosure of airspace 36 over immersion tank 18 is preferred because the majority of noxious fumes will be generated during the milling operation. By minimizing air dilution at this stage of operation, the critical reaction $$2NO + O_2\ 2NO_2$$

is enhanced. This oxidation of NO to $NO_2$ is of importance because $NO_2$ is readily soluble in water whereas NO is not. This reaction goes to completion, but the rate of $NO_2$ formation is very sensitive to NO concentration, as illustrated by the curve in FIG. 5. In FIG. 5, the critical factor for conversion of NO to $NO_2$ is the concentration of NO in air. As the concentration of NO in air increases, the oxidation rate or reaction velocity increases.

The most practical method of maximizing the conversion rate of NO to $NO_2$ is to minimize the air dilution during the reaction. The greater the $NO_x$ concentration in airspace 36 over immersion tank 18, the more rapidly water-soluble $NO_2$ is formed at the expense of the insoluble NO. Thus, the $NO_2$ gases produced during milling are transported (under their own vapor pressure or with minimal pumping) to water vessel 30 via line 31 where they are readily dissolved.

At the present state of the art, most chemical process operations operate scrubbers at about 50% to 60% efficiency, reducing the $NO_x$ concentration to about 1000 ppm. As air dilution approaches zero, the $NO_x$ concentration approaches 100%, and the time for conversion of NO to $NO_2$ approaches zero. In the system shown herein, efficiencies of 90% or better can be achieved.

In FIG. 2, the processing of workpiece 17 in holder 12 is shown by way of three different positions of holder 12 with respect to the containment 10. In position B, the holder is shown outside of containment 10 prior to entering outer subcompartment 11 via opening of outer door 14*a*. In position $B_1$, holder 12 is in outermost subcomparment 11, where it may be necessary to activate workpiece 17 surfaces by spraying with hydrochloric acid, or where washing workpiece 17 can be accomplished without allowing the escape of any noxious fumes. Outer subcompartment 11 will also provide a safe environment for personnel to inspect workpiece 17, i.e., to check the progress of milling between consecutive spray-etching or immersion operations.

In position $B_2$, holder 12 is shown in the actual milling position. Airspace 36 between the acid solution and cover 22 is vented to a vessel of water 30, to dissolve the undiluted $NO_x$ gases generated by the milling process. In the illustration of FIG. 2, immersion tank 18 is contained within a water bath 43 which is heated by a conventional thermastatically controlled heater 44. In many immersion milling operations, the acid solution must be heated to 140°–180° C.

Figure 4:
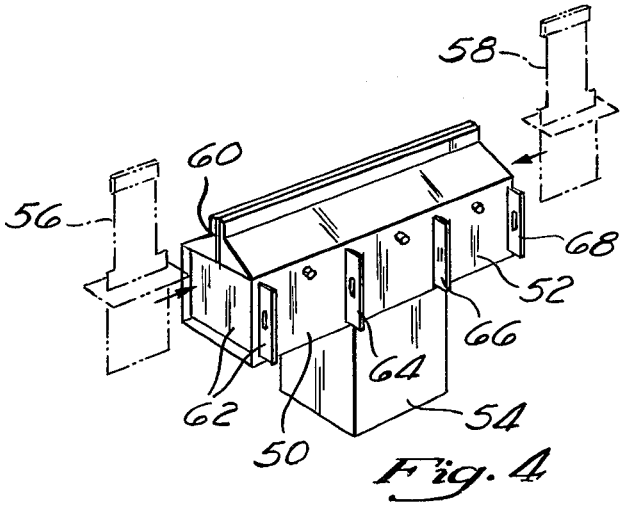
FIG. 4 is a representation of another possible configuration of the invention with compartments adjacent to the milling compartment on either side.

FIG. 4 illustrates another configuration of the invention wherein subcompartments 50 and 52 are provided on either side of milling subcompartment 54. A substantially similar tracking means 60, and partitioning means 62, 64, 66 and 68 is employed as earlier described with reference to FIGS. 1–3. It will be obvious to one skilled in the art that any number of variations of containment configurations are possible without deviating from the novelty of this invention. The configuration illustrated in FIG. 4 might be utilized in a conveyorized milling operation, or one requiring two distinct pre-treatments of various workpieces in holder 56 and 58. Another example of use for the configuration shown in FIG. 4 might involve the alternating immersions of two workpieces in holders 56 and 58 while one workpiece is being inspected, to increase efficiency of the operation.

It is to be understood that the invention can be adapted in configuration to suit the needs of the particular material to be milled. For example, the apparatus might be used for immersion milling as illustrated in FIG. 1, or adapted for spray etching (not shown).

To summarize briefly the novel operations of this invention, workpiece 17 is placed in workpiece holder 12 in the basket or carrier portion 21. Workpiece holder 12 is moved into outer subcompartment 11 after first sliding open door 14*a* in the direction shown by arrow A. Holder 12 is then placed in track 16 by placing the extension arm 19 between walls 16*a* and 16*b*. When partition 14*a* is closed, compartment 11 is made substantially vapor-tight, and if workpiece 17 is sprayed with hydrochloric acid, the fumes are contained and vented to a scrubber or treatment device 20 via ducts 27*a* and 29.

Partition 14*b* is slideably opened in the direction A, to allow holder 12 to slide along track 16 into subcompartment 13. Escape of fumes along the track is prevented by the pair of elongated, flexible, inert, gasket strips 34 which in a normal unflexed position engage with each other to form a seal. When deformed by extension arm 19 of holder 12, gasket 34 deforms to the shape of arm 19 to maintain a substantially vapor-tight seal.

Once inside subcompartment 13, holder 12 can be vertically lowered into immersion tank 18 via the means of cables or ropes 40. Air dilution and escape of fumes is prevented by holder cover 22 and its gasket 22*a* forming a seal over airspace 36. Once the appropriate immersion time has elapsed, holder 12 and workpiece 17 can be removed by reversing the above described procedure.

By way of specific example, in the etching of Inconel alloy (a nickel-chromium-Ion alloy), the temperature of the activating hydrochloric acid solution (muriatic acid) is preferably maintained at ambient temperature. To activate workpiece surface, the workpiece(s) 17 is sprayed with the hydrochloric acid solution in subcompartment 11. Immersion tank 18 contains aqua regia heated to approximately 140°-180° C. Holder 12 is lowered into tank 18 for milling for a period of time ranging from 15 minutes to an hour depending on the depth of milling or etching required. Tank 18 is preferably made of molded polypropylene with a fiberglas backing, as a fabricated tank might crack after long exposure to the hot acid solution. After immersion, the Inconel workpiece is removed to subcompartment 11 to be rinsed and/or inspected to determine how much further milling is required. Subcompartment 11 provides a safe environment for personnel free of noxious fumes.

The apparatus and method of this invention thus allow a safe, vapor-tight enclosure for chemical milling operations and associated procedures while efficiently promoting the solution and trapping, of noxious $NO_x$ fumes and thereby controlling the escape of any noxious fumes to the atmosphere.

I claim:

1. An apparatus for chemical milling of a workpiece, comprising:

(a) a substantially airtight, solid, enclosure means, with at least one compartment therein for the milling of said workpiece;

(b) at least a first substantially airtight compartment, communicating with said milling compartment wherein pre-treatment and post-treatment procedures are performed on said workpiece;

(c) means for introduction of said workpiece into said first compartment;

(d) means for transferring said workpiece from said first compartment to said milling compartment; and (e) means for removal and treatment of substantially all gases produced during treatment and/or milling of said workpiece.

2. The apparatus as defined in claim 1 which includes a workpiece holder for transferring said workpiece from said first compartment into said milling compartment.

3. The apparatus as defined in claim 1 wherein a slideably removable partition is interposed between said first compartment and said milling compartment.

4. The apparatus as defined in claim 1 in which said means for transferring said workpiece from said first compartment to said milling compartment includes a workpiece holder having an elongated extension arm, and a substantially airtight track extending from said first compartment to said milling compartment and within which said extension arm of said workpiece holder is confined for movement from compartment to compartment.

5. The apparatus of claim 1 wherein said enclosure means includes at least one slideably removable partition at the entrance to said first compartment.

6. The apparatus of claim 3 wherein said enclosure means includes at least one slideably removable partition at the entrance to said first compartment.

7. The apparatus as claimed in claim 2, in which said workpiece holder is provided with a cover, said milling compartment has a milling tank contained therein, said cover sealing said tank substantially airtight, during milling of said workpiece, and means for venting said milling tank of gases produced from below said cover during milling.

8. The apparatus of claim 7 wherein said workpiece holder includes a perforated carrier for said workpiece, and said cover is affixed to said workpiece holder above the carrier.

9. The apparatus of claim 8 wherein said cover is removably affixed to said workpiece holder.

10. The apparatus of claim 7 wherein said milling tank has means for thermostatic control of the temperature therein.

11. The apparatus of claim 7 wherein said means for venting said milling tank is located just below said cover.

12. The apparatus of claim 1 wherein said milling compartment is provided with a section thereof extending below said first compartment.

13. The apparatus of claim 7 wherein said gases produced during milling, are vented to a water-containing second tank.

14. The apparatus of claim 1 wherein said containment includes at least two substantially airtight, subcompartments, communicating with each other, and/or with said milling compartment.

15. A method for the removal of unwanted fumes during chemical treatment of a workpiece in a liquid media which comprises:

(a) introducing said workpiece into a first zone for pre-treatment and/or post-treatment of said workpiece, said zone being substantially vapor tight;

(b) transferring said workpiece from said first zone into a second substantially vapor tight treatment zone;

(c) reacting said workpiece in said treatment zone, in the presence of a minimum amount of air, to produce fumes in said treatment zone; and (d) venting said fumes into a third zone directly from said substantially vapor tight treatment zone.

16. The method of claim 15 wherein said third zone includes a water bath vessel in which said fumes are substantially soluble.

17. The method of claim 15 wherein the step of reacting said workpiece comprises a reaction with acid solutions at termperatures substantially above room temperature to produce being vented into a water bath.

18. The method of claim 15 wherein said pre-treatment of said workpiece includes an acid wetting of the surface of said workpiece.

19. The method of claim 15 wherein any fumes produced in said first zone are vented.

20. The method for chemical milling of a workpiece which comprises:

(a) pre-treating said workpiece in a completely enclosed, substantially vapor tight, first zone, venting any gases produced during said pre-treatment;

(b) passing said pre-treated workpiece into an acid-milling solution contained in a substantially vapor tight second zone, without any introduction of air, during the transfer of said pre-treated workpiece to said second zone;

(c) reacting said pre-treated workpiece with said acid-milling solution, at a temperature above ambient temperature, to produce nitrogen oxide fumes in said second zone in the presence of minimal amounts of air during the reaction; and (d) venting said fumes directly from said substantially airtight second zone, into a third zone comprising a water containing vessel for the dissolution of water soluble nitrogen oxide gases.

* * * * *